United States Patent [19]

Fukasawa et al.

[11] Patent Number: 4,787,832

[45] Date of Patent: Nov. 29, 1988

[54] AUTOMATIC AIR VENT DEVICE FOR FLUID PUMP OF INTERNAL COMBUSTION ENGINE

[75] Inventors: Masaho Fukasawa; Koji Abe, both of Hamamatsu, Japan

[73] Assignee: Sanshin Industries Co., Ltd., Hamamatsu, Japan

[21] Appl. No.: 15,443

[22] Filed: Feb. 17, 1987

[30] Foreign Application Priority Data

Feb. 18, 1986 [JP] Japan ..... 61-34455

[51] Int. Cl.[4] ..... F04B 7/06; F01M 9/00

[52] U.S. Cl. ..... 417/500; 417/502; 184/6.23

[58] Field of Search ..... 417/492, 500, 435, 502; 184/6.23; 123/196

[56] References Cited

U.S. PATENT DOCUMENTS

| | | | |
|---|---|---|---|
| 2,118,234 | 5/1938 | Rupp | 417/435 |
| 2,819,678 | 1/1958 | Nordell et al. | 417/571 |
| 3,181,473 | 5/1965 | Duron | 417/435 |
| 3,353,492 | 11/1967 | Heinzelmann et al. | 417/492 |
| 3,630,639 | 12/1971 | Duron | 417/435 |
| 3,936,244 | 2/1976 | Drori | 417/435 |
| 4,053,901 | 10/1977 | Shafuenstedt | 417/435 |

FOREIGN PATENT DOCUMENTS

| | | | |
|---|---|---|---|
| 996292 | 12/1951 | France | 417/500 |
| 48307 | 7/1983 | Japan | 417/500 |
| 48501 | 1/1985 | Japan | 417/502 |
| 1238948 | 7/1971 | United Kingdom | 417/497 |
| 48209 | 9/1982 | World Int. Prop. O. | 417/500 |

*Primary Examiner*—William L. Freeh

*Attorney, Agent, or Firm*—Ernest A. Beutler

[57] ABSTRACT

Several embodiments of venting arrangements for the lubricant pump of a two-cycle, crankcase compression internal combustion engine for an outboard motor and having a positive lubricating system. In each embodiment, the lubricant pump is provided with a vent passage that extends from an upper portion of a chamber of the pump for venting air from it. In each embodiment, an arrangement is provided for permitting air flow from the fluid pump without returning to the fluid pump. In some embodiments, this means comprises a check valve and in another embodiment, it comprises a restricted orifice.

9 Claims, 3 Drawing Sheets

AUTOMATIC AIR VENT DEVICE FOR FLUID PUMP OF INTERNAL COMBUSTION ENGINE

BACKGROUND OF THE INVENTION

This invention relates to an automatic air vent device for a fluid pump of an internal combustion engine and more particularly to an improved arrangement for venting air from a fluid pump without permitting the reentry of air into the pump through the venting passage.

Many types of fluid pumps are operated on an other than continuous basis. During the times when the pump is not pumping fluid, there is a risk that air will enter the pump and cause difficulties in restarting of the fluid flow once the pump is re-energized. For example, many forms of internal combustion engines employ fluid pumps. As an example, some types of two-cycle, crankcase compression engines have pumps for pressurizing lubricant and delivering it to a lubricating system of the engine. When the engine is not running and the lubricant pump is not being driven, there is a risk that air may enter the pump and cause difficulties in lubricant delivery on restarting. Although venting arrangements have been proposed for venting the lubricant pump so as to purge the air from the system, the venting passages raise the difficulty that air may in fact enter the system through the vent line.

It is, therefore, a principal object of this invention to provide an improved arrangement for venting a fluid pump.

It is a further object of this invention to provide a fluid pump vent that will effectively vent air from the pump but which will prevent the entry of air into the pump when the pump is running.

It is a still further object of this invention to provide an improved venting arrangement for the lubricant pump of an internal combustion engine.

SUMMARY OF THE INVENTION

This invention is adapted to be embodied in a fluid pump for an internal combustion engine that comprises an outer housing. A fluid inlet is formed in the outer housing as is a fluid outlet and a fluid path is formed within the outer housing that extends between the fluid inlet and the fluid outlet. The fluid path includes a pumping cavity that contains means for pressuring the fluid therein for flow through the fluid path. In accordance with the invention, a vent passage extends from the fluid path for venting air therefrom and means are provided for precluding air flow through the vent passage back into the fluid path.

DETAILED DESCRIPTION OF THE PREFERRED EMBODIMENTS

Figure 1:
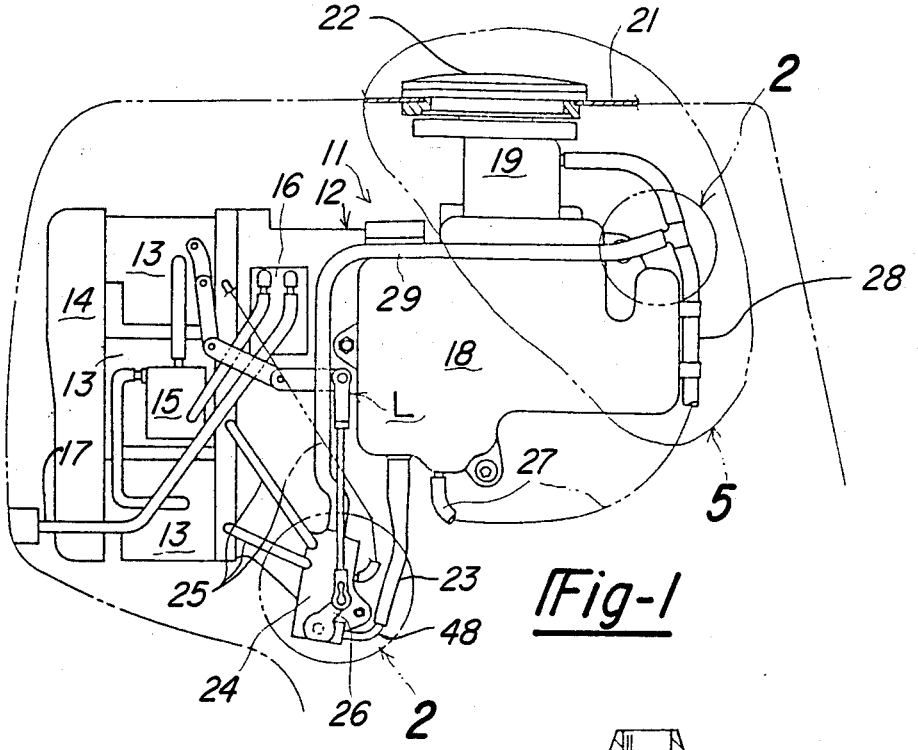
FIG. 1 is a partial side elevational view of an outboard motor constructed in accordance with an embodiment of the invention.

Referring first to FIG. 1, a portion of an outboard motor constructed in accordance with an embodiment of the invention is identified generally by the reference numeral 11. In FIG. 1, only a portion of the power head of the outboard motor 11 is shown and it contains an internal combustion engine 12 of the two-cycle, crankcase compression type that is provided with individual sealed crankcase chambers to which a fuel/air charge is delivered through an intake manifold from carburetors 13 in which throttle valves (not shown) are provided. The carburetors 13 receive a silenced charge of air from an air silencer inlet device 14. An engine driven fuel pump 15 supplies fuel to the carburetors 13 in a known manner. The fuel pump 15, in turn, receives filtered fuel from a fuel filter 16. The fuel is delivered to the fuel filter 16 from a remotely positioned fuel tank (not shown) through a conduit 17.

The portion of the engine thus far described may be considered to be conventional. Details of the conventional components of the engine are not necessary to understand the invention. It is also to be understood that, although the invention is described in connection with an outboard motor, the invention may be utilized with any of a variety of engines. However, certain facets of the invention have particularly utility in connection with outboard motors.

The engine 12 is provided with a separate lubricating system that includes a lubricant storage tank 18 that is mounted on the side of the engine 12 in a known manner. The tank 18 has a fill neck 19 that extends in proximity to an opening in a protective cowling 21 of the outboard motor. The opening receives a removable cap 22 for replenishment of the lubricant within the lubricant storage tank 18.

A conduit 23 delivers lubricant under gravity flow from the tank 18 to a lubricant pump 24, which will be described in more detail by reference to the remaining figures. The lubricant pump 24, in turn, has a plurality of outlets from which conduits 25 extend so as to deliver lubricant to the intake manifold of the engine for mixture with the fuel/air charge from the carburetors prior to introduction into the crankcase chambers. It is to be understood that although the invention is described with a system in which the lubricant is delivered to the induction fuel/air flow, the invention may be utilized in conjunction with engines that have direct lubrication of certain components. Alternatively, the invention may also be employed with engines of the type wherein the lubricant is mixed with the fuel before delivery to the carburetors 13.

A lever 26 is affixed to the side of the lubricant pump 24 and acts, in a manner to be described, so as to control the amount of lubricant discharged. In accordance with the illustrated embodiment, the lever 26 is connected by a linkage system L to the throttle valve of one of the carburetors 13 so as to vary the output of the lubricant pump 24 in response to throttle valve position.

The lubricant tank 18 is provided with a drain and sight level conduit 27 that extends from a lowermost portion of the tank 18 to the fill neck 19, in a manner which will be described by particular reference to FIG. 2. A sight gauge 28 is provided in this line so that an operator may readily determine the amount of lubricant in the tank 18.

The lubricant pump 24 is also provided with a venting system, to be described in conjunction with the remaining figures, which includes a conduit 29 that extends to the drain and sight gauge conduit 28.

The construction of the lubricant pump 24 will now be described by principal reference to FIGS. 2 through 4. The lubricant pump 24 includes an outer housing 31 that defines an internal cavity that is made up of a plurality of vertically spaced portions. These portions include a first, upper bore 32, a second reduced diameter bore 33 and an adjustment somewhat larger diameter bore 34. Beneath the bore 34, there is provided a chamber 35 that contains the cam mechanism, to be described, for driving the pump 24 and for changing the pump output.

A plunger 36 is slidably supported within the bore 33. The plunger 36 has a depending tongue portion 37 (FIG. 3) that is received within a groove 38 formed on a cylindrical extension 39 of a gear 41 which is rotatably journaled within the bore 34. The gear 41 is of the spur type and is driven by a driving spur gear 42 that is connected to an engine driven shaft. As a result of the tongue and groove connection 37, 38, the plunger 36 will rotate with the gear 41.

The lower surface of the gear 41 is formed with a pair of cam shaped projections 42 that cooperate with a pair of cylindrical members 43 that are affixed to a shaft 44 to which the lever 26 is affixed. The cylindrical portions 43 cooperate with the cam surfaces 42 so as to effect reciprocation of the gear 41 and plunger 36 as the gear 41 is driven by the gear 42. The plunger reciprocates twice per revolution of the gear 41. A coil compression spring 45 is positioned at the top of the housing and urges the plunger 36 and gear 41 downwardly into engagement with the cylindrical members 43.

The stroke of the gear 41 and plunger 36 and, accordingly, the displacement of the pump 24 is adjusted by means of an eccentric cam member 46 that is carried on the shaft 44 between the cylindrical members 43. A cylindrical stop 47 is affixed to the gear 41 between the cams 42 and is adapted to engage the cam 46 upon appropriate rotation of the shaft 44 so as to limit the downward movement of the plunger 36 and the gear 41 and, accordingly, their stroke so as to limit the displacement of the pump 24. As has been previously noted, this variation in displacement depends upon the positioning of the throttle valves of the carburetors 13 as determined through the linkage system L (FIG. 1).

The chamber consisting of the bores 32, 33, 34 and cavity 35 forms a portion of a fluid path through the housing 33. This fluid path includes an inlet port that is provided by an inlet fitting 48 that is affixed to the lower end of the housing 33 and which communicates with the chamber 35. The fitting 48 is connected to the conduit 23 (FIG. 1) so as to receive lubricant from the storage tank 18 under gravity flow, as aforenoted.

Figure 3:
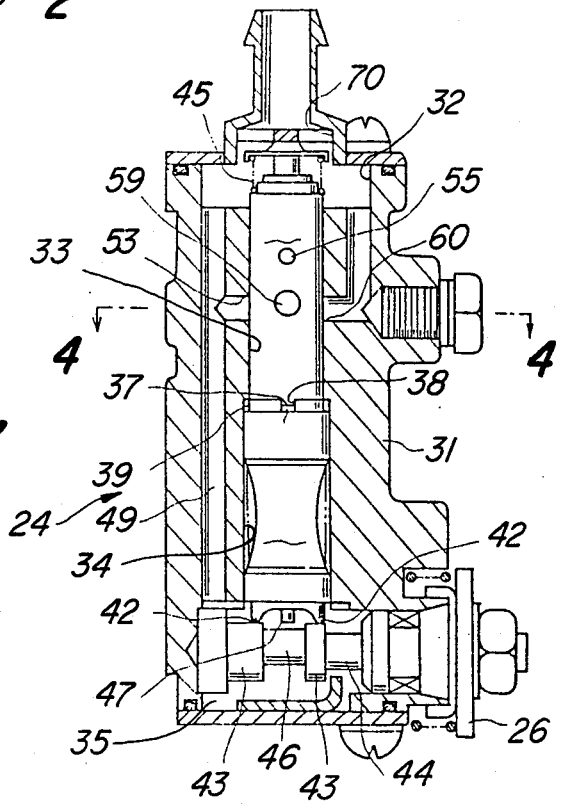
FIG. 3 is a cross-sectional view taken along the line 3—3 of FIG. 2.
Figure 4:
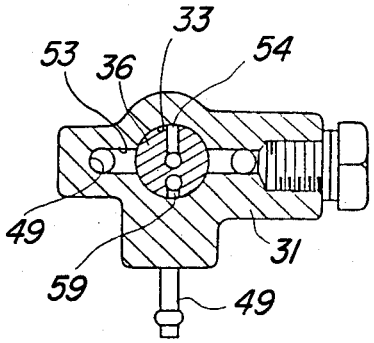
FIG. 4 is a cross-sectional view taken along the line 4—4 of FIG. 3.

The chamber 35 communicates with the bore 32 through a vertically extending passage 49 formed in the housing 33 at one side of the chamber defined by the bores 32, 33, 34 and chamber 35 as best shown in FIGS. 3 and 4.

A first pumping chamber is defined by a bore 51 formed in the upper end of the plunger 36 in which is received a fixed piston 52. The piston 52 is affixed to the cover plate of the housing 33 and is surrounded by the spring 45. The first pumping chamber 51 receives fluid from the passage 49 through a transverse passage 53 formed in the housing 33. A further passageway 54 is formed in the plunger 36 and communicates with the passageway 53 when the plunger 36 is at the lower portion of its stroke. As the plunger 36 rotates and moves upwardly due to the operation of the cams 42 with the surfaces 43, the compressed fluid is delivered through a discharge passage 55 formed in a side of the plunger 36 to a first outlet passage 56 formed in the housing 33 during one of the strokes which occurs each revolution. The first outlet passage 56 cooperates with a first outlet fitting 57 that extends to one of the discharge lines 25 (FIG. 1).

During the other one-half rotation of the plunger 36, fluid will be drawn into the first pumping chamber 51 through the registry of the passageway 59 of the plunger with a passageway 60 that is formed in the outer housing 33 and which communicates with the bore 32. The bore 32, in turn, receives fluid through its intersection with the passageway 49.

As the plunger 36 continues its rotation and undergoes a pumping stroke, the fluid compressed within the first pumping chamber 51 will be forced through the discharge port 55 through a passageway 58 into the bore 32. Since the disclosed lubricating system requires only three pressure outlets, the lubricant pumped during this cycle is not delivered to the engine. This pressurized lubricant may be delivered to an appropriate portion of the engine if desired.

The annular recess 39 formed between the upper end of the gear 41 and the upper portion of the bore 34 forms a second pumping chamber. As aforenoted, the plunger 36 makes two strokes for each revolution of the gear 41. During one of the two strokes the plunger 36 makes each revolution, fluid from the housing passage 53 passes through an inlet port 59 formed in the plunger 36 when the pump is in a predetermined position and wherein the gear 41 is at the lower portion of its stroke. A clearance 61 formed at the bottom of the tongue and groove connection 37 and 38 completes this communication path. During the other stroke, the inlet port communicates with the housing passage 60.

As the gear 41 rotates and is raised by the action of the cams 42, the fluid will become compressed and delivered through an outlet port 62 formed in the plungers 36 sequentially to discharge ports 63 and 64 formed in the housing 33. Discharge nipples 65 and 66 are connected to the discharge ports and to selected of the conduits 25 (FIG. 1) so as to complete the discharge path to the engine.

It should be readily apparent that when the outboard motor and specifically the engine 12 is not operating, there is a possibility of air leaking into the pump 24 from a variety of sources but primarily through the discharge lines 25. If this air is not bled from the system upon restarting, there is the likelihood that the air could be pumped through the delivery lines 25 resulting in inadequate lubrication for the engine. In accordance with the invention, the venting system including the conduit 29 is provided so as to relieve the air from the line and to insure that it will not be pumped through the system.

Figure 2:
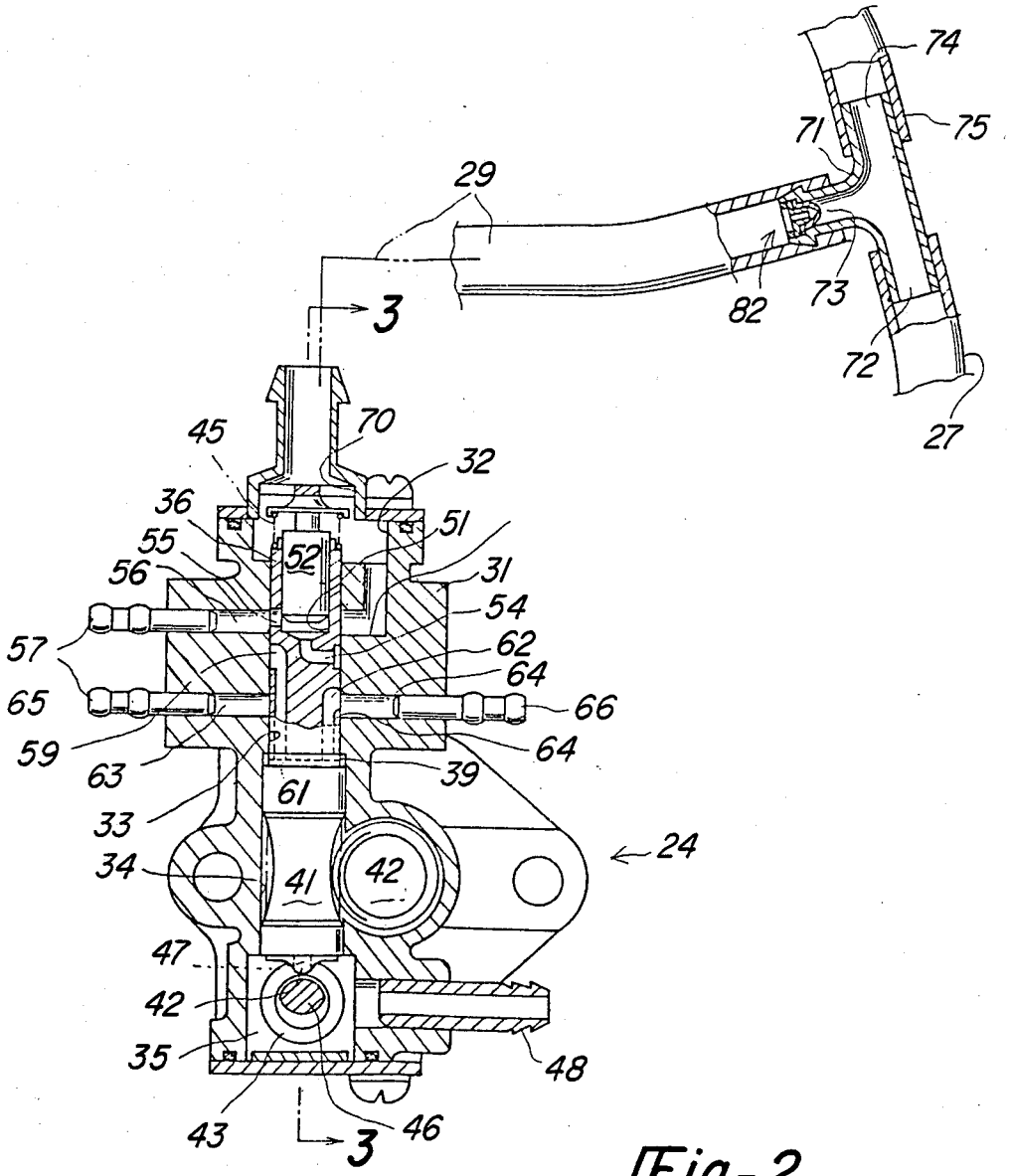
FIG. 2 is an enlarged cross-sectional view taken of the area encompassed within the circles 2 of FIG. 1.
Figure 5:
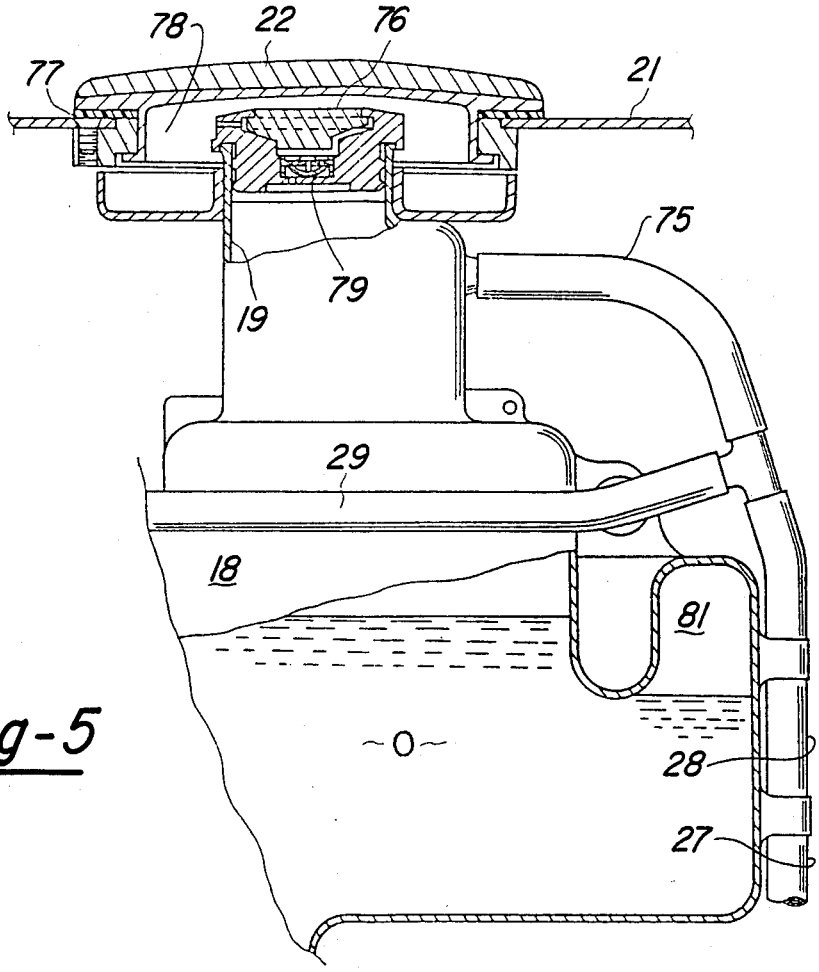
FIG. 5 is an enlarged view, with a portion broken away and another portion shown in section, of the area encompassed within the phantom line 5 in FIG. 1.

This venting system will not be described by particular reference to FIGS. 2 and 5. The vent line 29 communicates at one end with a vent opening 70 formed above the bore 32. As has been noted, the other end of the vent line 29 is T'd into the return and sight line 27. For this purpose, there is provided a T connection 71 that has a first arm 72 that is connected to the return and sight line 27. A second arm 73 of the T connection 71 is connected to the vent conduit 29. A third arm 74 of the T connection 71 is connected to a vent line 75 that extends back to the filler neck 19 (FIG. 5).

It should be noted that the filler cap 22 is provided with an internal cap 76 that is concealed by the protective housing cap 22 and which cap 76 is, itself, contained on the filler neck 19. The cap 22 is affixed to the protective cowling 21 by means including a floating gasket 77.

A chamber 78 is provided between the caps 22 and 76 and a vent passageway including a check valve 79 carried by the cap 76 permits air to enter the tank 18 to compensate for the lubricant that has been consumed. This prevents a partial vacuum from being established above the lubricant which might restrict lubricant flow. The check valve 79 will, however, prevent lubricant from leaking from the tank 18, even if the outboard motor is laid on its side.

It should be noted that the tank 18 is provided with an expansion chamber 81 so as to trap a certain amount of air when the filler cap 76 is replaced on the filler neck 19 so as to prevent the establishment of a positive pressure in the lubricant. The chamber 81 also permits expansion of the lubricant if it becomes heated, as by sunlight or engine operation.

The vertical disposition of the vent line 29 and the fact that it extends to the vent port 70 which is placed at the vertically uppermost portion of the pump chamber 32 insures that any air in the system will flow upwardly out of the pump 24 back through the vent line 29 to the tank 18 and thus avoid the likelihood that the flow of lubricant to the engine will be irregular or intermittent when the engine is restarted.

In order to prevent any air from flowing back into the chamber of the housing 24 through the vent line 29, there is provided a duck bill type check valve 82 in the arm 73 of the T 71 that extends to the conduit 29. The check valve 82 will permit air to flow out of the line 29 back to the tank 18 but prevents air from flowing back to the pump 24 through the line 29. It is to be understood, however, that the check valve may be placed at any other location along the vent path.

Figure 6:
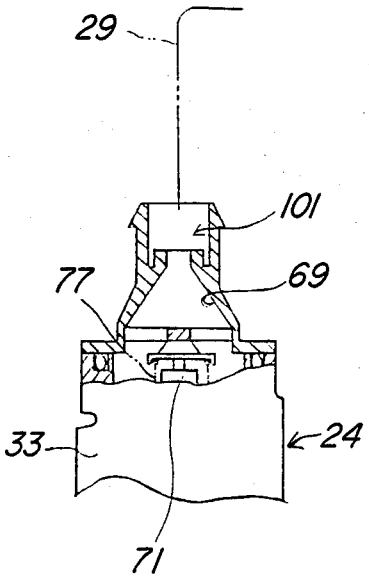
FIG. 6 is a partial cross-sectional view, in part similar to FIG. 2, showing another embodiment of the invention.

FIG. 6 shows another embodiment of the invention. In this embodiment, rather than using a check valve, there is provided a restricted orifice 101 at the upper end of the vent opening 69. The orifice 101 is sized so as to permit the flow of air out of the lubricant pump 24 back to the vent line 29 under pump operation while precluding flow in an opposite direction when the pump 29 is not driven.

Figure 7:
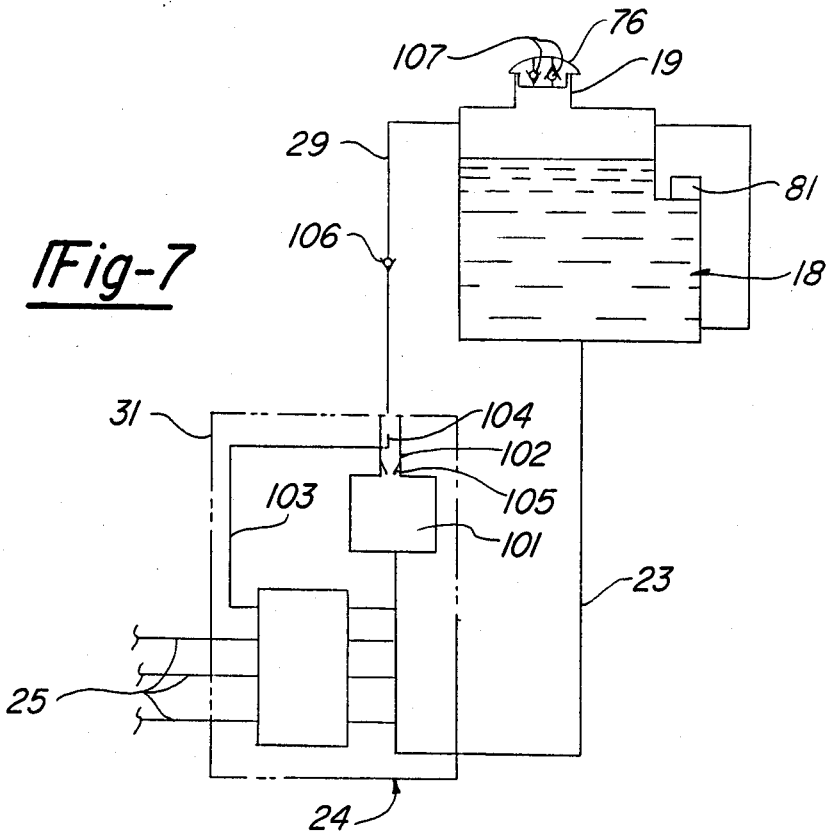
FIG. 7 is a schematic view showing a still further embodiment of the invention.

In the two embodiments of the invention thus far illustrated and described, the air has been purged out of the pump 24 by permitting it to flow upwardly due to its lighter density relative to the heavier lubricant. However, it can also be practiced to employ the operation of the pump itself as a device for pumping air out of the system and FIG. 7 shows such an embodiment. In this embodiment, the major components of the system are the same as those embodiments previously described and, therefore, where this is the case, those embodiments have been identified by the same reference numerals.

In this embodiment, there is provided a chamber 101 within the pump housing 31 which communicates with the inlet line 23. In addition, the output of the second pumping chamber 51 during the one-half cycle which was returned to the chamber 32 in the embodiment of FIGS. 1 through 6 is delivered to a vent conduit 102 through a conduit 103 and an upwardly directed outlet 104. The outlet 104 discharges fluid and air, if present in the system, upwardly to the vent line 29. A restricted orifice 105 is provided in the vent line 102 and communicates with the chamber 101 so as to permit the purging of air without having air reenter the system. In addition, a check valve 106 is provided in the vent line 29 so as to prevent reverse air flow. In this embodiment, the fill cap 76 is provided with a pair of oppositely acting check valves 107 which act to permit air to enter the tank 108 to make up for the loss of volume as the lubricant is consumed. In addition, one of the check valves 107 permits air to be purged from the tank under the operation of the pump 24 so that any vented air can be discharged to the atmosphere without pressurizing the area in the tank 108 above the level of the lubricant.

It should be readily apparent from the foregoing description that a number of embodiments of the invention have been illustrated and described and each of which provides a very effective arrangement for purging air from a fluid pump without causing the likelihood of entry of air back to the pump when it is not operating. Although the invention is described in conjunction with a lubricant pump, it should be readily apparent that the invention may be utilized with a wide variety of types of pumps.

It is also to be understood that the foregoing description is that of preferred embodiments of the invention and that various changes and modifications may be made without departing from the spirit and scope of the invention, as defined by the appended claims.

What is claimed is:

1. A fluid pump of an internal combustion engine comprising an outer housing, a fluid inlet in said outer housing, a fluid outlet in said outer housing, a fluid path formed within said outer housing extending between said fluid inlet and said fluid outlet and including a pumping cavity containing means for pressurizing fluid for fluid flow through said fluid outlet, a vent passage extending vertically upwardly from said fluid path for venting air under its own buoyancy in the pumped fluid therefrom, and means for precluding reverse air flow from said vent passage into said fluid path while permitting air to flow by its own buoyancy in the pumped fluid from said fluid path to said vent passage.

2. A fluid pump as set forth in claim 1 wherein the vent passage communicates with an area that is sequentially pressurized during pump operation.

3. A fluid pump as set forth in claim 2 wherein the means for precluding air flow through the vent passage into the fluid path comprises a check valve.

4. A fluid pump as set forth in claim 2 wherein the means for precluding air flow through the vent passage into the fluid path comprises a restricted orifice for permitting air to flow in one direction during pump operation but being sized to be effective to prevent air flow in the opposite direction when the pump is not operating.

5. A fluid pump for an internal combustion engine comprising an outer housing extending in a generally vertical direction, a fluid inlet communicating with a fluid inlet chamber formed at the bottom of said outer housing, a pumping cavity positioned vertically above said fluid inlet chamber and communicating therewith, a fluid outlet in said outer housing communicating with said pumping chamber for receiving pressurized fluid therefrom a venting chamber formed in said outer housing above said pumping cavity, a fluid passage extending vertically through said outer housing from said fluid inlet chamber to said venting chamber, for venting air therefrom, and means for precluding reverse air flow from a vent passage extending from said venting chamber through said vent passage into said venting chamber.

6. A fluid pump as set forth in claim 5 wherein passage means sequentially communicate said fluid passage with said pumping chamber for delivering fluid from said fluid passage to said pumping chamber.

7. A fluid pump as set forth in claim 6 further including means for delivering fluid from said pumping chamber under pressure to said venting chamber during a portion of the pump operation.

8. A fluid pump as set forth in claim 7 wherein the means for precluding air flow through the vent passage into the fluid path comprises a check valve.

9. A fluid pump as set forth in claim 7 wherein the means for precluding air flow through the vent passage into the fluid path comprises a restricted orifice for permitting air to flow in one direction during pump operation but being sized to be effective to prevent air flow in the opposite direction when the pump is not operating.

* * * * *